US012486842B1

(12) United States Patent
Cortes et al.

(10) Patent No.: US 12,486,842 B1
(45) Date of Patent: Dec. 2, 2025

(54) REMOVABLE PACKING GLAND ASSEMBLY

(71) Applicant: SPM Oil & Gas Inc., Fort Worth, TX (US)

(72) Inventors: Adalberto Cortes, Fort Worth, TX (US); Alireza Atabaie, Keller, TX (US); Chandu Kumar, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 0 days.

(21) Appl. No.: 18/678,612

(22) Filed: May 30, 2024

(51) Int. Cl.
*F04B 53/16* (2006.01)

(52) U.S. Cl.
CPC ..... *F04B 53/164* (2013.01)

(58) Field of Classification Search
CPC ..... F04B 53/22; F04B 49/065; F04B 17/03; F04B 35/04; F04B 49/06; F04C 14/00; F04C 28/00; F04C 2270/00; F04D 15/00; F04D 27/00
See application file for complete search history.

(56) References Cited

U.S. PATENT DOCUMENTS

| | | | | |
|---|---|---|---|---|
| 11,725,651 | B2 | 8/2023 | Myers et al. | |
| 11,815,085 | B1 * | 11/2023 | Brunet | E21B 43/26 |
| 2011/0048698 | A1 * | 3/2011 | McGuire | E21B 43/2607 166/177.5 |
| 2019/0011051 | A1 * | 1/2019 | Yeung | F04B 53/10 |
| 2022/0349472 | A1 * | 11/2022 | Ellisor | F16J 15/56 |
| 2022/0412346 | A1 | 12/2022 | Nowell et al. | |
| 2023/0141878 | A1 | 5/2023 | Poehls et al. | |
| 2023/0258175 | A1 | 8/2023 | Figgs et al. | |

FOREIGN PATENT DOCUMENTS

WO 2021195572 A1 9/2021

* cited by examiner

*Primary Examiner* — Shafiq Mian

(57) ABSTRACT

A packing gland assembly may include a packing gland housing defining a bore extending from a front end to a rear end of the packing gland housing. The packing gland housing may include a flange having a front face, that defines the front end of the packing gland housing, and a rear face. The flange may define a plurality of apertures that extend from the front face of the flange to the rear face of the flange. The packing gland housing may include a mating neck extending from the flange to the rear end of the packing gland housing. The mating neck may define a stepped circumferential surface having one or more steps, and may define a circumferential groove.

20 Claims, 8 Drawing Sheets

REMOVABLE PACKING GLAND ASSEMBLY

TECHNICAL FIELD

The present disclosure relates generally to fluid pumps and, for example, to a removable packing gland assembly.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

Positive displacement pumps are commonly used for high pressure hydrocarbon recovery applications, such as injecting hydraulic fracturing fluid down the wellbore. A positive displacement pump typically has two sections, a power end and a fluid end. The power end includes a crankshaft powered by an engine or another power source that drives plungers of the fluid end. The fluid end includes cylinders into which the plungers operate to allow fluid into fluid chambers and then forcibly push out from the fluid chambers at a high pressure to a discharge manifold, which may be in fluid communication with a well head. A seal assembly, also called a packing, packing assembly, or stuffing box, may be disposed in a packing bore of a cylinder chamber to prevent leakage of fluid from around a plunger during pumping operations. Over time, the packing bore may experience excessive wear due to high applied pressures and reciprocation of the plunger, which can lead to leaks and/or failure of the packing bore. Repair of the packing bore is difficult, and in cases of severe wear, the entire fluid end may be replaced.

The removable packing gland assembly of the present disclosure solves one or more of the problems set forth above and/or other problems in the art.

SUMMARY

A fluid end for a fluid pump may include a fluid end block defining a fluid chamber and a packing gland assembly. The packing gland assembly may include a packing gland housing, interfaced with the fluid chamber, defining a bore extending from a front end to a rear end of the packing gland housing. The packing gland housing may include a flange having a front face, that defines the front end of the packing gland housing, and a rear face. The flange may define a plurality of apertures that extend from the front face of the flange to the rear face of the flange. The packing gland housing may include a mating neck extending from the flange to rear end of the packing gland housing. The mating neck may define a stepped circumferential surface having one or more steps, and may define a circumferential groove. The packing gland assembly may include a sealing ring disposed in the circumferential groove, and a plurality of fasteners extending through the plurality of apertures and into the fluid end block to connect the packing gland housing to the fluid end block.

A packing gland assembly may include a packing gland housing defining a bore extending from a front end to a rear end of the packing gland housing. The packing gland housing may include a flange having a front face, that defines the front end of the packing gland housing, and a rear face. The flange may define a plurality of apertures that extend from the front face of the flange to the rear face of the flange. The packing gland housing may include a mating neck extending from the flange to the rear end of the packing gland housing. The mating neck may define a stepped circumferential surface having one or more steps, and may define a circumferential groove.

A fluid pump may include a power end and a fluid end coupled to the power end. The fluid end may include a fluid end block defining a fluid chamber and a packing gland assembly. The packing gland assembly may include a packing gland housing, interfaced with the fluid chamber, defining a bore extending from a front end to a rear end of the packing gland housing. The packing gland housing may include a flange defining a plurality of apertures, and a mating neck extending from the flange. The mating neck may define a stepped circumferential surface having one or more steps, and may define a circumferential groove. The mating neck may have a face that defines the rear end of the packing gland housing, and the face of the mating neck may directly abut against the fluid end block. The packing gland assembly may include a sealing ring disposed in the circumferential groove, and a plurality of fasteners extending through the plurality of apertures and into the fluid end block to connect the packing gland housing to the fluid end block.

DETAILED DESCRIPTION

This disclosure relates to a removable packing gland assembly, which is applicable to any reciprocating pump. For example, the reciprocating pump may be used in a hydraulic fracturing application.

Figure 1:
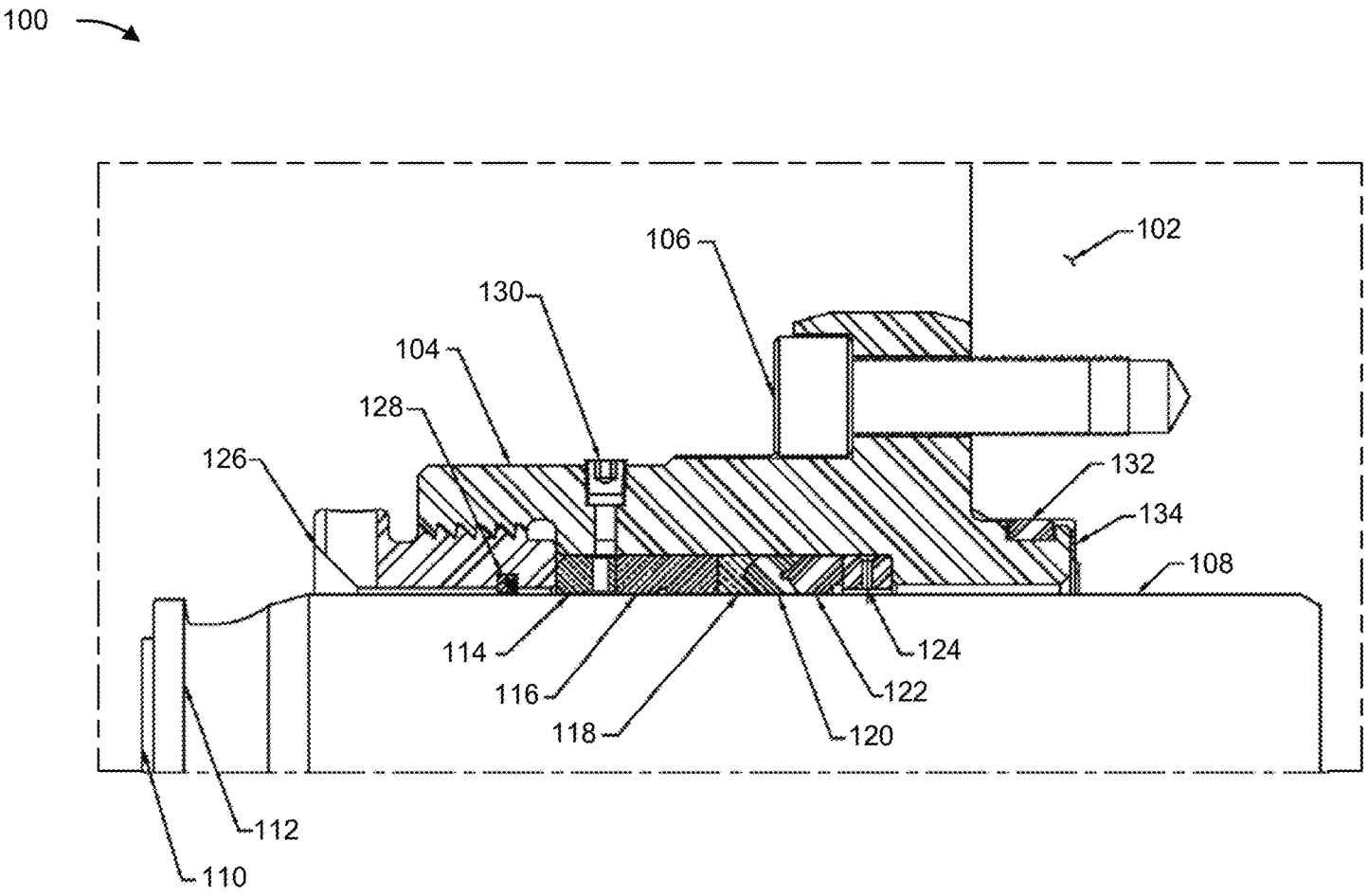
Prior Art FIG. 1
FIG. 1 is a cross-sectional view of an example prior art fluid end of a fluid pump.

FIG. 1 is a cross-sectional view of an example prior art fluid end 100 of a fluid pump. FIG. 1 shows a top half of the cross-sectional view; a bottom half of the cross-sectional view may be identical or similar to the top half. As shown, the fluid end 100 includes a fluid cylinder 102, a packing gland 104 connected to the fluid cylinder 102 by one or more bolts 106, and a plunger 108 configured to reciprocate within the fluid cylinder 102 and the packing gland 104. The plunger 108 includes a plunger pilot 110, and a plunger or pony rod clamp shoulder 112.

Packing, including a lantern ring 114, a female adapter 116, a peek adapter 118, a pressure ring 120, a header ring 122, and/or a steel spacer 124, is disposed within the packing gland 104 around the plunger 108. A packing nut 126 is secured to an interior surface of the packing gland 104 and maintains the packing in a proper position. A wiper seal 128 is positioned between the packing nut 126 and the plunger 108. The packing gland 104 includes a lube oil or grease inlet 130 to lubricate the packing.

A sealing D-ring 132 is positioned between the packing gland 104 and the fluid cylinder 102 to seal fluid in the fluid cylinder 102. A steel pressure ring 134 is positioned in a gap between the packing gland 104 and the fluid cylinder 102 to further seal fluid in the fluid cylinder 102.

Figure 2:
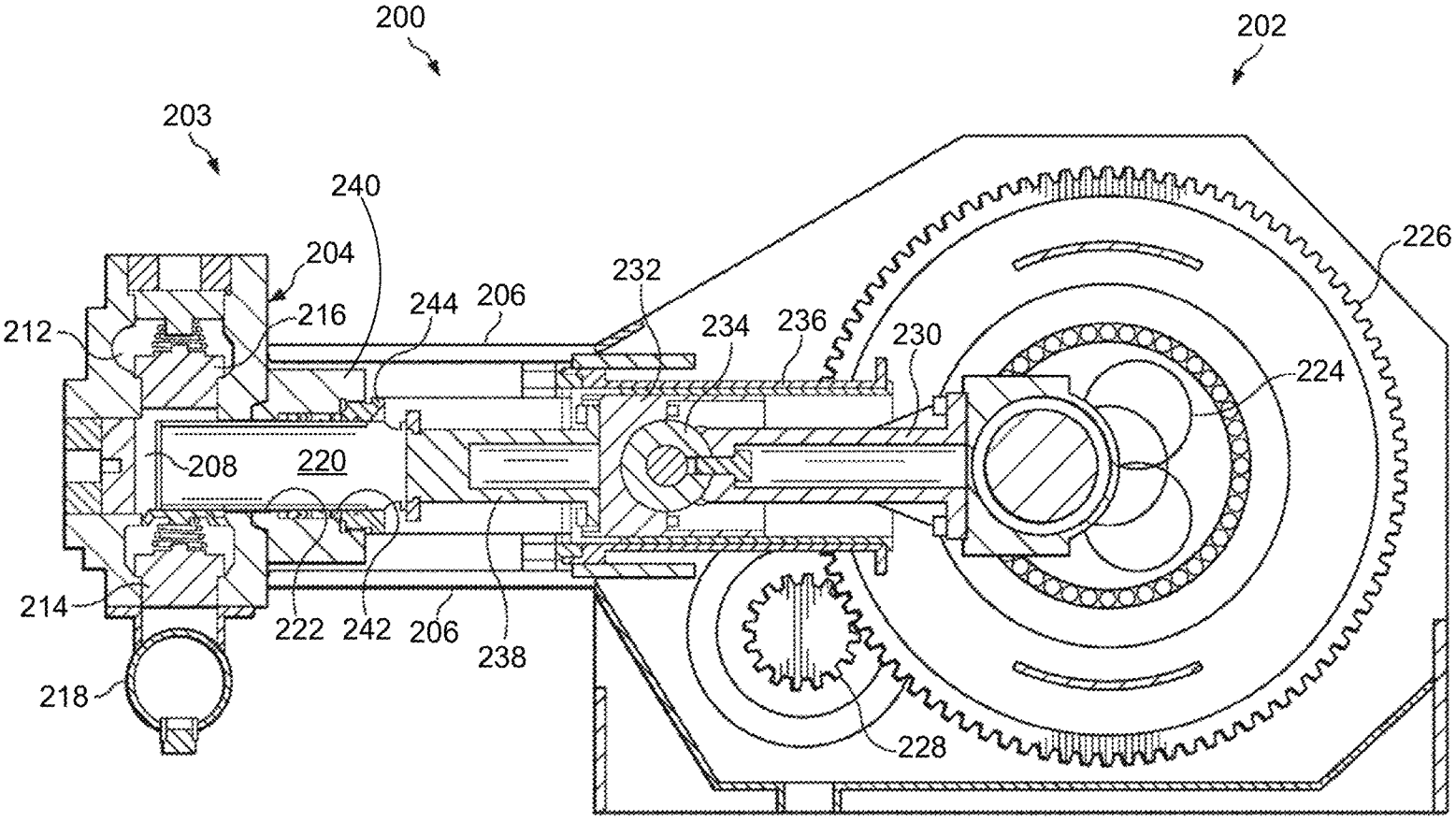
FIG. 2 is a diagram illustrating a cross-sectional view of an example fluid pump.

FIG. 2 is a diagram illustrating a cross-sectional view of an example fluid pump 200. In some implementations, the fluid pump 200 may be mounted on a trailer to facilitate transportation of the fluid pump 200 between operational sites. The fluid pump 200 may be a reciprocating pump, as shown.

The fluid pump 200 includes a power end 202 and a fluid end 203 having a fluid end block 204. The fluid end 203 may be connected to the power end 202 by stay rods 206. The fluid end block 204 defines one or more fluid chambers 208 (only one shown). For example, the fluid pump 200 may include one, two, three, four, five, or more fluid chambers 208 and associated components. A fluid chamber 208 may sometimes be referred to as a "bore" of the fluid pump 200.

The fluid pump 200 includes a suction valve 214 that is configured to control fluid suction into the fluid chamber 208. Similarly, the fluid pump 200 includes a discharge valve 216 that is configured to control fluid discharge from the fluid chamber 208. During a suction stroke of a plunger 220, fluid is allowed to flow from a suction manifold 218 through the suction valve 214 and into the fluid chamber 208. The fluid is then pumped in response to a discharge stroke (e.g., a forward stroke) of the plunger 220 and flows through the discharge valve 216 into a discharge port 212. The discharge port 212 may be fluidly coupled to a wellbore to supply high pressure fluid to the wellbore for fracturing rock formations and other uses. In operation, the reciprocating plunger 220 moves in a plunger bore 222 and is driven by the power end 202 of the fluid pump 200.

The power end 202 may include a crankshaft 224 that is rotated by a gearbox output 226 (illustrated by a single gear, but may be more than one gear). A gearbox input 228 is coupled to a transmission (not shown) and a power source (not shown), such as a diesel engine, to rotate the gearbox input 228 during operation. A connecting rod 230 mechanically connects the crankshaft 224 to a crosshead 232 via a wrist pin end 234. The crosshead 232 is mounted within a stationary crosshead housing 236, which constrains the crosshead 232 to linear reciprocating movement. A pony rod 238 connects to the crosshead 232 and has its opposite end connected to the plunger 220 to enable reciprocating movement of the plunger 220. The plunger 220 may be one of a plurality of plungers, such as, for example, three or five plungers, depending on the size of the fluid pump 200 (e.g., three cylinder, five cylinder, etc.) and the number of fluid chambers 208.

The plunger 220 extends through the plunger bore 222 so as to interface and otherwise extend within the fluid chamber 208. In operation, movement of the crankshaft 224 causes the plunger 220 to reciprocate within, or move linearly toward and away from, the fluid chamber 208. As the plunger 220 translates away from the fluid chamber 208 (a suction stroke of the plunger 220), the pressure of the fluid inside the fluid chamber 208 decreases, which creates a pressure differential across the suction valve 214. The pressure differential across the suction valve 214 enables actuation (e.g., opening) of the suction valve 214 to allow the fluid to enter the fluid chamber 208 from the suction manifold 218 (e.g., the fluid is pressurized to a low pressure, such as 80 psi, by an outside system, such as a centrifugal pump, and pushed through the suction manifold 218). The pumped fluid is pushed into the fluid chamber 208 as the plunger 220 continues to translate away from the fluid chamber 208. As the plunger 220 changes directions and moves toward the fluid chamber 208 (a discharge stroke of the plunger 220), the fluid pressure inside the fluid chamber 208 increases, which creates a pressure differential across the discharge valve 216. Fluid pressure inside the fluid chamber 208 continues to increase as the plunger 220 approaches the fluid chamber 208 until the pressure differential across the discharge valve 216 is great enough to actuate (e.g., open) the discharge valve 216 and enable the fluid to exit the fluid chamber 208.

A packing gland housing 240 is connected to the fluid end block 204 interfacing with the fluid chamber 208. A packing 242 is disposed in a packing bore of the packing gland housing 240 and surrounds the plunger 220, which extends through the packing gland housing 240. A packing nut 244 is threaded into the packing gland housing 240, and acts to retain the packing 242 in the proper position within the packing bore. When properly positioned, the packing 242 and the packing nut 244 maintain the necessary pressure between the plunger 220 and the packing 242, and prevent the packing bore from leaking. In some implementations, a replaceable sleeve or liner may be positioned in the packing bore interfacing with the packing 242.

As indicated above, FIG. 2 is provided as an example. Other examples may differ from what is described with regard to FIG. 2.

Figure 3:
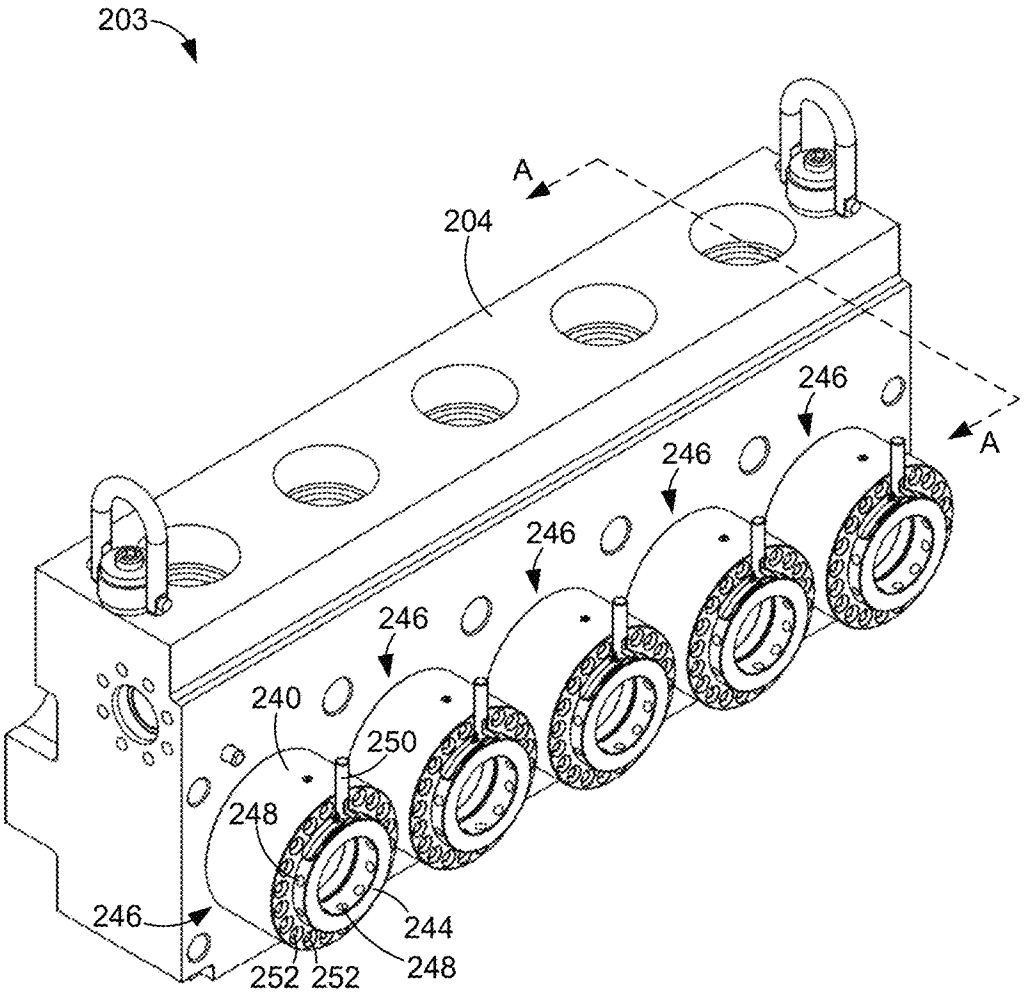
FIG. 3 is a diagram illustrating a perspective view of an example fluid end of a fluid pump.

FIG. 3 is a diagram illustrating a perspective view of an example fluid end 203 of the fluid pump 200. As shown, the fluid end 203 includes a fluid end block 204 and one or more packing gland assemblies 246 connected to the fluid end block 204. For example, as shown, five packing gland assemblies 246 may be connected to the fluid end block 204, one at each fluid chamber 208 (e.g., one at each cylinder) of the fluid end block 204. However, the fluid end 203 may include a different number of packing gland assemblies 246 (e.g., three packing gland assemblies 246), depending on the size of the fluid pump 200 (e.g., three cylinder, five cylinder, etc.) and the number of fluid chambers 208.

A packing gland assembly 246 may include a packing gland housing 240 and/or a packing nut 244 secured to (e.g., threaded into) the packing gland housing 240. A plurality of holes 248 may be located along a rim of the packing nut 244, which may be used to tighten or loosen the packing nut 244 with respect to the packing gland housing 240. In some implementations, the packing gland assembly 246 may include a nut lock 250 configured to engage with the packing nut 244, thereby restricting rotation of the packing nut 244. For example, the nut lock 250 may include an extendable pin that can be extended into a hole 248 of the packing nut 244, thereby rotationally locking a position of the packing nut 244.

The packing gland assembly 246 includes a plurality of fasteners 252 (e.g., a plurality of bolts) to connect (e.g., fasten) the packing gland housing 240 to the fluid end block 204. In this way, the packing gland housing 240 can be removed from the fluid end block 204 to facilitate repair or replacement of the packing gland housing 240. Accordingly, failure of a packing bore can be resolved more efficiently through removal of the packing gland assembly 246, rather than replacement of the entire fluid end 203. Moreover, by using a removable packing gland assembly 246, the fluid end block 204 can be fabricated using a smaller raw starting block compared to a raw starting block that would be used to fabricate a fluid end block with integrated packing glands, thereby conserving a significant amount of material.

In some implementations, the fluid end block 204 is composed of a first material, and the packing gland housing 240 is composed of a second material different from the first material. For example, the first material may be a first steel composition and the second material may be a second steel composition. This may facilitate simplified and lower-cost manufacturing of the packing gland housing 240.

As indicated above, FIG. 3 is provided as an example. Other examples may differ from what is described with regard to FIG. 3.

Figure 4:
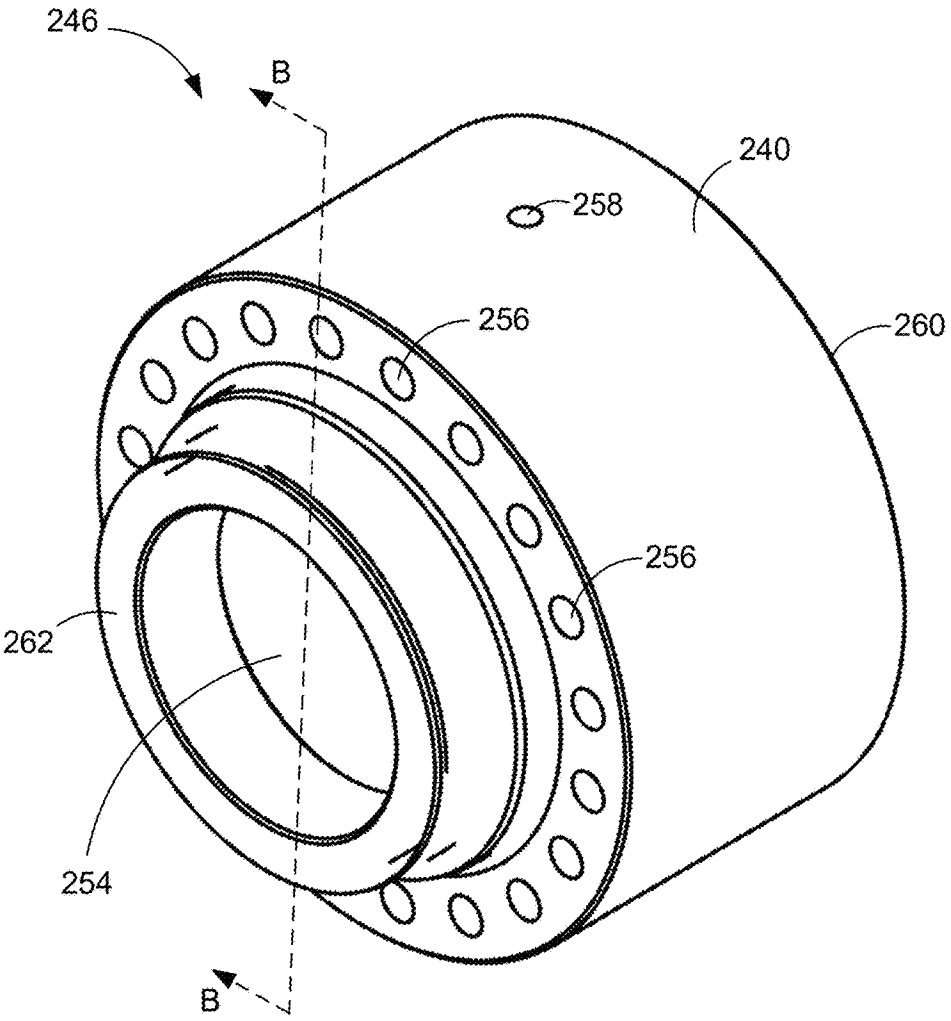
FIG. 4 is a diagram illustrating a perspective view of an example packing gland housing.

FIG. 4 is a diagram illustrating a perspective view of an example packing gland housing 240. The packing gland housing 240 defines a bore 254. The bore 254 extends from a front end 260 (e.g., a first end) to a rear end 262 (e.g., a second end) of the packing gland housing 240. The bore 254 may define an inner circumferential surface and an outer circumferential surface of the packing gland housing 240 (e.g., the packing gland housing 240 may be annularly shaped). The bore 254 may define a packing bore of the packing gland housing 240 (e.g., where packing is filled) and/or define at least a portion of the plunger bore 222.

As shown, the packing gland housing 240 includes a plurality of apertures 256 configured to receive respective fasteners 252. The apertures 256 may be located in the packing gland housing 240 around the bore 254. In some implementations, a port 258 is defined through the packing gland housing 240 for introducing lube oil or grease into the bore 254.

As indicated above, FIG. 4 is provided as an example. Other examples may differ from what is described with regard to FIG. 4.

Figure 5:
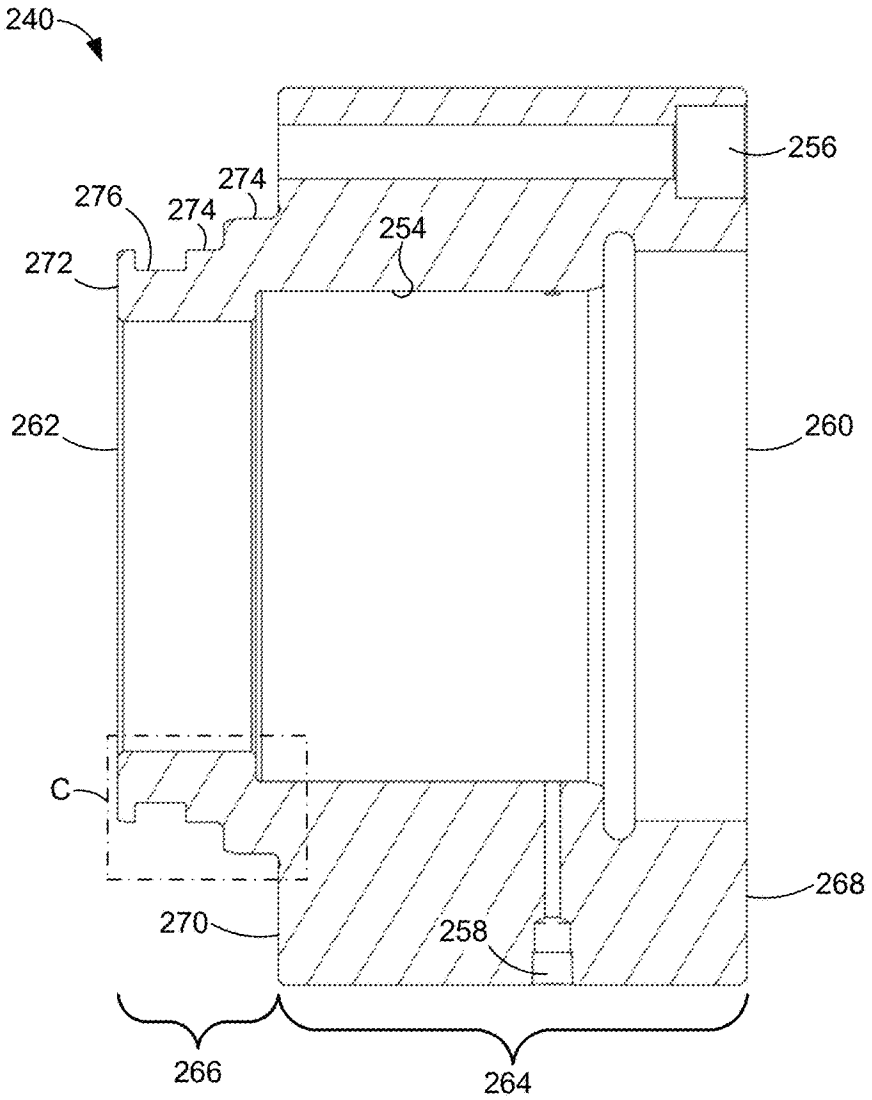
FIG. 5 is a diagram illustrating a cross-sectional view of the packing gland housing of FIG. 4 taken along line B-B

FIG. 5 is a diagram illustrating a cross-sectional view of the packing gland housing 240 of FIG. 4 taken along line B-B. As shown, the packing gland housing 240 has a flange 264 and a mating neck 266 extending from the flange 264. The flange 264 and the mating neck 266 may be an integral unit.

The flange 264 may have an overall annular shape, or another shape such as a hexagonal shape or octagonal shape. The flange 264 has a front face 268 (e.g., a front annular face) that defines the front end 260 of the packing gland housing 240, and a rear face 270 (e.g., a rear annular face). The front face 268 and the rear face 270 of the flange 264 define a thickness of the flange 264. The apertures 256 may be defined in the flange 264 extending from the front face 268 to the rear face 270 of the flange 264. The apertures 256 may be threaded to facilitate engagement with threads on the fasteners 252. In some examples, an aperture 256 may include a countersunk section and a threaded section. The front face 268 of the flange 264 also defining the front end 260 of the packing gland housing 240 gives the flange 264 a significant thickness, which reduces movement of the packing gland housing 240 and improves a seal strength between the packing gland housing 240 and the fluid end block 204.

The mating neck 266 may extend from the flange 264 (e.g., from the rear face 270 of the flange 264) to the rear end 262 of the packing gland housing. For example, a face 272 of the mating neck 266 may define the rear end 262 of the packing gland housing 240. The mating neck 266 is configured for insertion into the fluid end block 204 (e.g., such that the bore 254 is aligned with a cylinder of the fluid end block 204). To achieve this, the mating neck 266 defines a stepped circumferential surface having one or more steps 274. Moreover, the mating neck 266 defines a circumferential groove 276 configured to receive a sealing ring, as described herein. The step(s) 274 may be located between the circumferential groove 276 and the flange 264. In some implementations, the mating neck 266 has at least two steps 274. For example, a first step 274 may project from the circumferential groove 276, and a second step 274 may extend from the rear face 270 of the flange 264.

As further shown in FIG. 5, in some examples, the bore 254 may include multiple sections having different diameters. For example, at a first section of the bore 254 (nearest to the front end 260 of the packing gland housing 240), the inner circumferential surface of the packing gland housing 240 may be threaded to engage with threads on the packing nut 244. A second section of the bore 254 (a middle section) may define the packing bore (e.g., that is not threaded) that can be filled with packing. A third section of the bore 254 (nearest to the rear end 262 of the packing gland housing 240) may be narrower than the second section to define a ledge of the packing bore on which packing can be stacked.

As indicated above, FIG. 5 is provided as an example. Other examples may differ from what is described with regard to FIG. 5.

Figure 6:
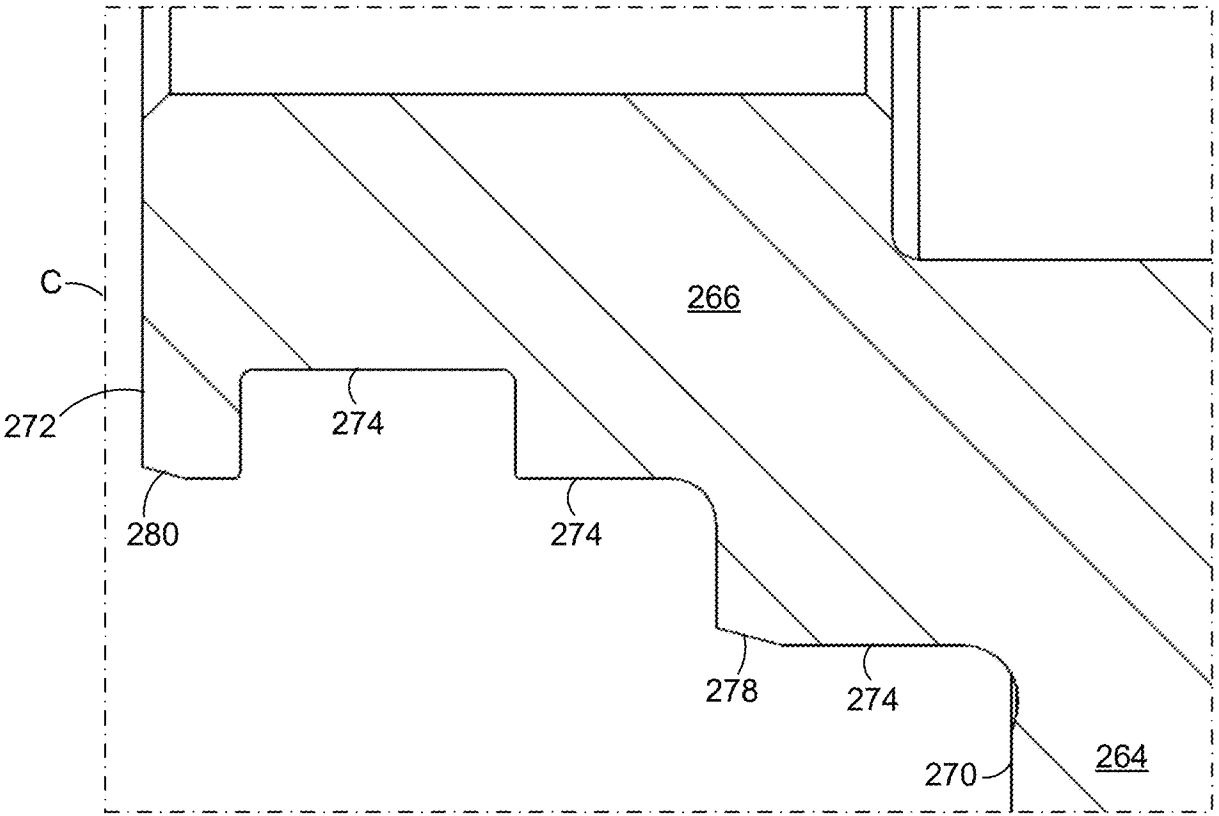
FIG. 6 is a diagram illustrating an enlarged cross-sectional view of a stepped circumferential surface of a mating neck.

FIG. 6 is a diagram illustrating an enlarged cross-sectional view of the stepped circumferential surface of the mating neck 266. As shown, one or more of the steps 274 may have a chamfered corner 278. For example, the step 274 that extends from the rear face 270 of the flange 264 may have the chamfered corner 278. Additionally, or alternatively, a leading edge of the face 272 of the mating neck 266 may have a chamfered corner 280. The chamfered corners 278, 280 may have a length-to-width ratio of X:1, where X>1 or X>2. For example, the chamfered corners 278, 280 may have a length-to-width ratio of 3:1. The chamfered corners 278, 280 facilitate guiding of the mating neck 266 into the fluid end block 204.

As indicated above, FIG. 6 is provided as an example. Other examples may differ from what is described with regard to FIG. 6.

Figure 7:
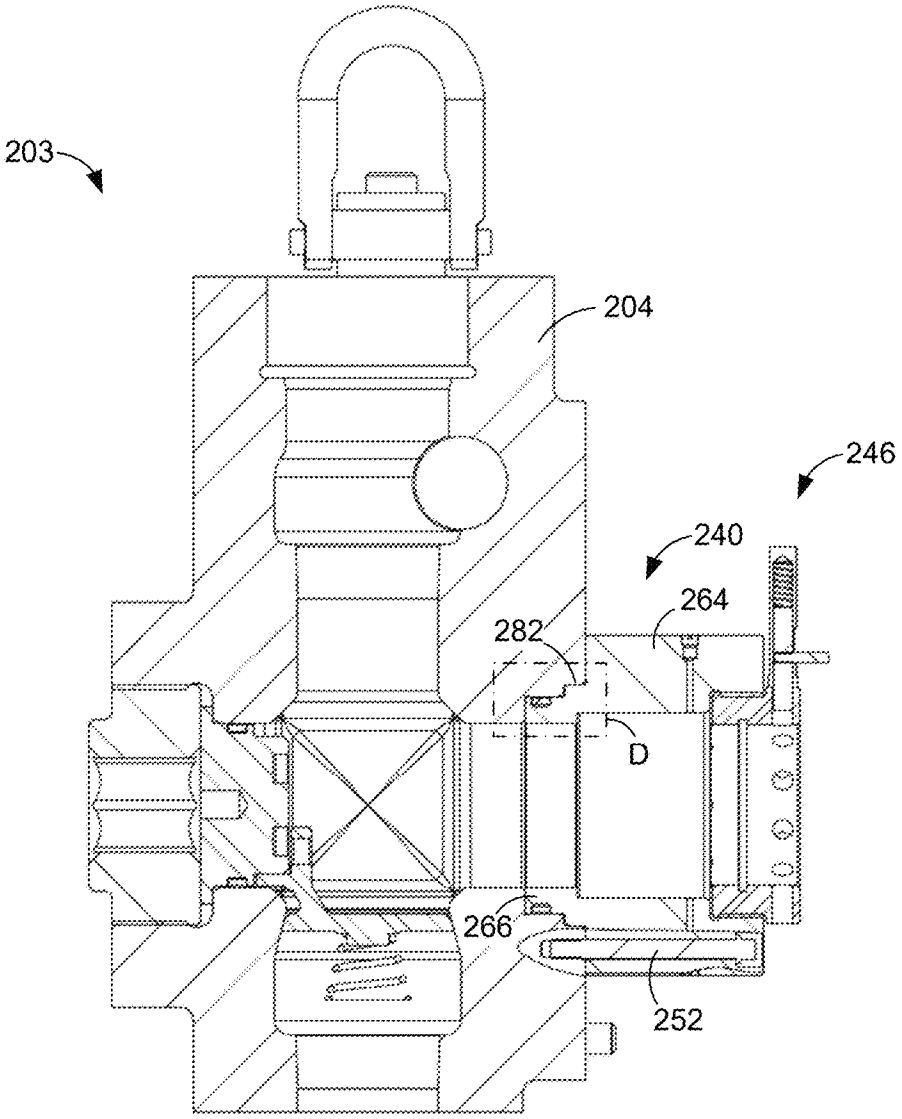
FIG. 7 is a diagram illustrating a cross-sectional view of the fluid end of FIG. 3 taken along line A-A.

FIG. 7 is a diagram illustrating a cross-sectional view of the fluid end 203 of FIG. 3 taken along line A-A. The fluid end 203 may include a stepped port 282 that receives the mating neck 266 of the packing gland housing 240. For example, the stepped port 282 is matched to (e.g., is an inverse of) the stepped circumferential surface of the mating neck 266. Thus, with the packing gland housing 240 connected to the fluid end block 204, the mating neck 266 of the packing gland housing 240 is received into the stepped port 282 of the fluid end block 204, the flange 264 of the packing gland housing 240 abuts an exterior surface of the fluid end block 204, and the fasteners 252 connect the packing gland housing 240 and the fluid end block 204.

As indicated above, FIG. 7 is provided as an example. Other examples may differ from what is described with regard to FIG. 7.

Figure 8:
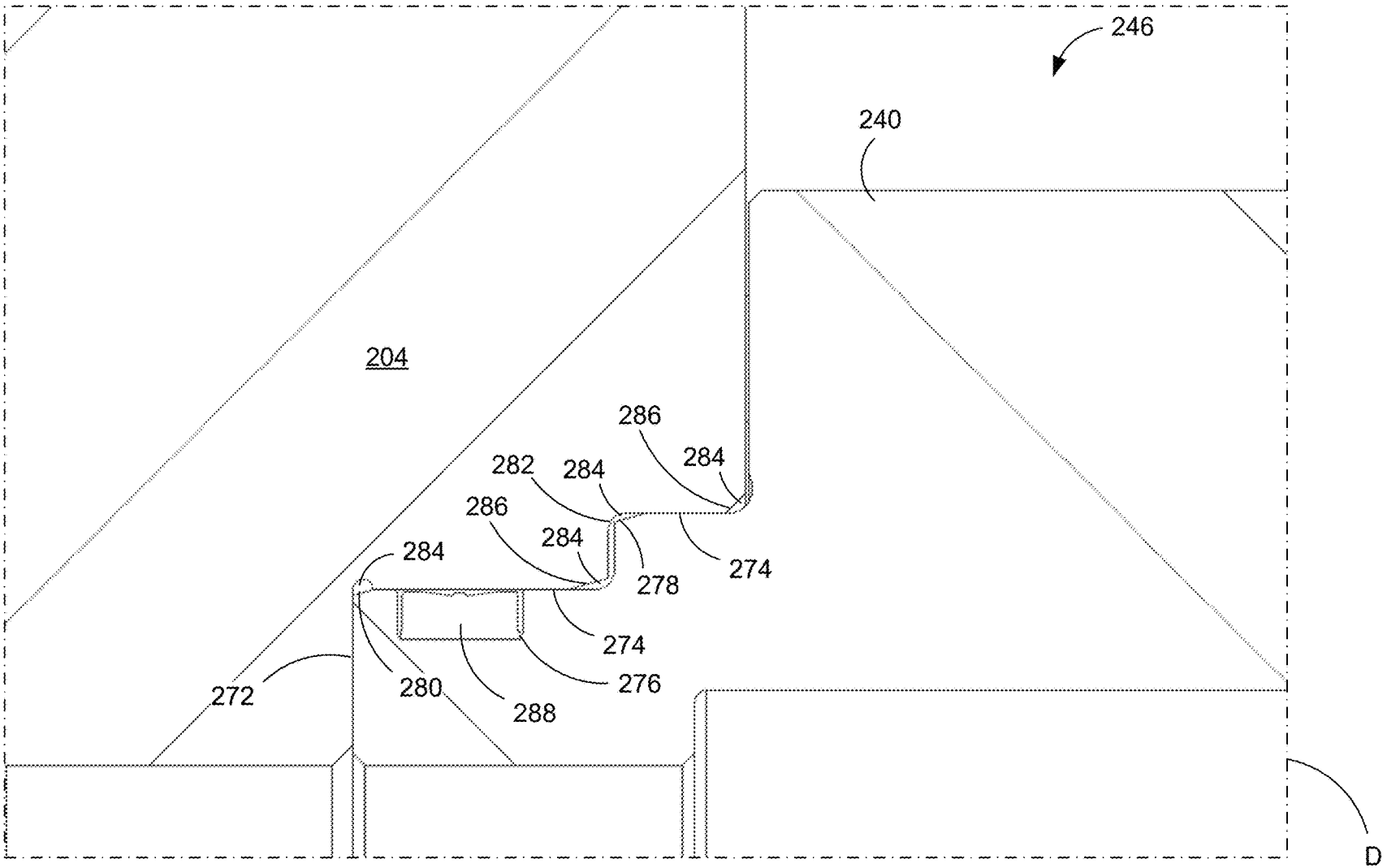
FIG. 8 is a diagram illustrating an enlarged cross-sectional view of an interface between a fluid end block and a packing gland housing.

FIG. 8 is a diagram illustrating an enlarged cross-sectional view of an interface between the fluid end block 204 and the packing gland housing 240. As shown, the face 272 of the mating neck 266 directly abuts against the fluid end block 204 (e.g., without an intervening pressure ring or gasket), thereby providing a flush interface between the mating neck 266 and the fluid end block 204 that promotes fluid tightness. To facilitate the flush interface between the fluid end block 204 and the face 272 of the mating neck 266, one or more gaps 284 may be defined between the steps 274 of the mating neck 266 and the stepped port 282 of the fluid end block 204. For example, a profile of the stepped port 282 of the fluid end block 204 and a profile of the mating neck 266 may be configured to define the gaps 284. As an example, the chamfered corners 278, 280 of the mating neck 266, as well as similar chamfered corners 286 of the stepped port 282 (e.g., at a leading edge of the stepped port 282 and/or at a corner of one or more steps of the stepped port 282), may result in the gaps 284. The gaps 284 allow maneuverability between the fluid end block 204 and the packing gland housing 240 to ensure a tight fit at the interface between the face 272 of the mating neck 266 and the fluid end block 204.

As further shown, the packing gland assembly 246 may include a sealing ring 288 disposed in the circumferential groove 276. The sealing ring 288 provides an additional fluid-tight seal between the packing gland housing 240 and the fluid end block 204. In some implementations, the sealing ring 288 may have a raised central portion and raised edge portions, thereby defining a channel between a first raised edge portion and the raised central portion and a channel between a second raised edge portion and the raised central portion.

As indicated above, FIG. 8 is provided as an example. Other examples may differ from what is described with regard to FIG. 8.

INDUSTRIAL APPLICABILITY

The packing gland assembly 246 described herein may be used with any fluid pump that uses a plunger to pressurize fluid. For example, the packing gland assembly 246 may be used with a positive displacement pump, such as a reciprocating pump. In particular, the packing gland assembly 246 may be employed in a fluid pump used in an application relating to oil and gas extraction, such as hydraulic fracturing. The packing gland assembly 246 can be filled with a packing that surrounds the plunger to prevent leakage of fluid from around the plunger during pumping operations. In general, packing can wear down adjacent surfaces resulting in a "wash boarding" effect that can lead to leaks and seal failure. These surfaces may also experience wear due to high applied pressures within the fluid pump. When a packing gland is integrated with a fluid end block (e.g., as a single unit), the repair of worn surfaces is difficult, and oftentimes the entire fluid end block is replaced when repair is not possible.

The packing gland assembly 246 described herein is removable from the fluid end block 204. For example, the fasteners 252 that secure the packing gland housing 240 to the fluid end block 204 can be loosened to allow the packing gland housing 240 to be removed for easier repair or replacement. Accordingly, the fluid end block 204 does not need to be scrapped merely because of worn surfaces of the packing gland housing 240.

Additionally, the packing gland assembly 246 described herein provides improved leak resistance. For example, the front face 268 of the flange 264 also defining the front end 260 of the packing gland housing 240 gives the flange 264 a significant thickness, which reduces movement of the packing gland housing 240 relative to the fluid end block 204 and improves a seal strength between the packing gland housing 240 and the fluid end block 204. Furthermore, the stepped circumferential surface of the mating neck 266, as well as the chamfered corners 278, 280 define gaps 284 between the steps 274 of the mating neck 266 and the stepped port 282 of the fluid end block 204, thereby allowing for maneuverability between the fluid end block 204 and the packing gland housing 240. This maneuverability ensures a tight fit where the face 272 of the mating neck 266 directly abuts against the fluid end block 204, thereby improving fluid tightness and reducing leakage.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "front," "rear," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A fluid end for a fluid pump, comprising:
- a fluid end block defining a fluid chamber; and
- a packing gland assembly, comprising:
  - a packing gland housing, interfaced with the fluid chamber, defining a bore extending from a front end to a rear end of the packing gland housing, the packing gland housing comprising:
    - a flange having a front face, that defines the front end of the packing gland housing, and a rear face,
      - the flange abutting an exterior surface of the fluid end block, and the flange defining a plurality of apertures that extend from the front face of the flange to the rear face of the flange; and
    - a mating neck extending from the flange to the rear end of the packing gland housing,
      - the mating neck received in the fluid end block, and the mating neck defining a stepped circumferential surface having one or more steps, and defining a circumferential groove;
    - a sealing ring disposed in the circumferential groove; and
    - a plurality of fasteners extending through the plurality of apertures and into the fluid end block to connect the packing gland housing to the fluid end block.

2. The fluid end of claim 1, wherein at least one step of the one or more steps has a chamfered corner.

3. The fluid end of claim 1, wherein the one or more steps comprise at least two steps.

4. The fluid end of claim 1, wherein the one or more steps are located between the circumferential groove and the flange.

5. The fluid end of claim 1, wherein the mating neck has a face that defines the rear end of the packing gland housing, and wherein the face of the mating neck directly abuts against the fluid end block.

6. The fluid end of claim 1, wherein one or more gaps are defined between the one or more steps and the fluid end block.

7. The fluid end of claim 1, wherein the bore defines an inner circumferential surface and an outer circumferential surface of the packing gland housing, and wherein the inner circumferential surface is threaded to engage with threads on a packing nut.

8. The fluid end of claim 1, further comprising a plunger extending through the bore of the packing gland housing, wherein the packing gland assembly further comprises:

a packing surrounding the plunger;

a packing nut, inserted into the bore, surrounding the plunger and retaining the packing; and a nut lock configured to engage with the packing nut.

9. The fluid end of claim 1, wherein the plurality of fasteners comprise a plurality of bolts.

10. The fluid end of claim 1, wherein the fluid end block is composed of a first material, and the packing gland housing is composed of a second material different from the first material.

11. A packing gland assembly, comprising:

a packing gland housing defining a bore extending from a front end to a rear end of the packing gland housing, the bore defining an inner circumferential surface and an outer circumferential surface of the packing gland housing, and the inner circumferential surface being threaded to engage with threads on a packing nut, the packing gland housing comprising:

a flange having a front face, that defines the front end of the packing gland housing, and a rear face, the flange defining a plurality of apertures that extend from the front face of the flange to the rear face of the flange; and a mating neck extending from the flange to the rear end of the packing gland housing, the mating neck defining a stepped circumferential surface having one or more steps, and defining a circumferential groove.

12. The packing gland assembly of claim 11, further comprising:

a sealing ring disposed in the circumferential groove.

13. The packing gland assembly of claim 11, wherein the plurality of apertures are threaded.

14. The packing gland assembly of claim 11, wherein at least one step of the one or more steps has a chamfered corner.

15. The packing gland assembly of claim 11, wherein the one or more steps comprise at least two steps.

16. A fluid pump, comprising:

a power end; and a fluid end, coupled to the power end, comprising:

a fluid end block defining a fluid chamber; and a packing gland assembly, comprising:

a packing gland housing, interfaced with the fluid chamber, defining a bore extending from a front end to a rear end of the packing gland housing, the packing gland housing comprising:

a flange defining a plurality of apertures; and a mating neck, extending from the flange, defining a stepped circumferential surface having one or more steps, and defining a circumferential groove, the mating neck having a face that defines the rear end of the packing gland housing, and the face of the mating neck directly abutting against the fluid end block;

a sealing ring disposed in the circumferential groove; and a plurality of fasteners extending through the plurality of apertures and into the fluid end block to connect the packing gland housing to the fluid end block.

17. The fluid pump of claim 16, wherein at least one step of the one or more steps has a chamfered corner.

18. The fluid pump of claim 16, wherein the one or more steps comprise at least two steps.

19. The fluid pump of claim 16, wherein the flange has a front face that defines the front end of the packing gland housing, and a rear face, and wherein the plurality of apertures extend from the front face of the flange to the rear face of the flange.

20. The fluid pump of claim 16, wherein the fluid end further comprises a plunger extending through the bore of the packing gland housing, and wherein the packing gland assembly further comprises:

a packing surrounding the plunger; and a packing nut, inserted into the bore, surrounding the plunger and retaining the packing.

* * * * *